US007172437B2

(12) United States Patent
Maebashi

(10) Patent No.: US 7,172,437 B2
(45) Date of Patent: Feb. 6, 2007

(54) ELECTRICAL JUNCTION BOX

(75) Inventor: Akemi Maebashi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/441,218

(22) Filed: May 26, 2006

(65) Prior Publication Data

US 2006/0216968 A1 Sep. 28, 2006

Related U.S. Application Data

(62) Division of application No. 10/828,355, filed on Apr. 21, 2004, now Pat. No. 7,077,667.

(30) Foreign Application Priority Data

Apr. 22, 2003 (JP) ..... 2003-117208
Apr. 22, 2003 (JP) ..... 2003-117213
Apr. 22, 2003 (JP) ..... 2003-117221

(51) Int. Cl.
*H01R 12/00* (2006.01)
*H01R 4/60* (2006.01)

(52) U.S. Cl. ..... 439/76.2; 439/205

(58) Field of Classification Search ..... 439/190, 439/205, 206, 76.2, 949
See application file for complete search history.

(56) References Cited

U.S. PATENT DOCUMENTS 4,954,085 A * 9/1990 Inoue et al. ..... 439/206
4,963,099 A * 10/1990 Sato et al. ..... 439/206
5,516,301 A * 5/1996 Kawakita ..... 439/206
5,618,199 A * 4/1997 Conorich et al. ..... 439/934
6,319,057 B2 * 11/2001 Sekido et al. ..... 439/190
6,428,331 B1 * 8/2002 Yamakawa et al. ..... 439/76.2
6,443,748 B1 * 9/2002 Yuasa ..... 439/205

FOREIGN PATENT DOCUMENTS

| | | |
|---|---|---|
| DE | 32 09 915 A1 | 9/1983 |
| JP | 05-054787 | 3/1993 |
| JP | 05-260628 | 10/1993 |
| JP | 10-210631 | 8/1998 |
| JP | 11-032415 | 2/1999 |
| JP | 11-122752 | 4/1999 |
| JP | 11-285132 | 10/1999 |

* cited by examiner

*Primary Examiner*—Briggitte R. Hammond
(74) *Attorney, Agent, or Firm*—Finnegan, Henderson, Farabow, Garrett & Dunner, L.L.P.

(57) ABSTRACT

A relay part is housed in a case, a fuse mounting part is provided above the relay part in the case and a fuse is attached/detached to/from the fuse mounting part from above the case. In the case, provided are an internal cover and a bus bar supporting resin body, which cover the periphery of the relay part. A drainage channel is provided in outer surfaces of the internal cover and the bus bar supporting resin body. In addition, a drainage hole which drains water flowing through the drainage channel to the outside of the case is provided in the case. The drainage channel includes an upper groove which is formed in an upper surface of the bus bar supporting resin body and has an inclined surface on its bottom and a side groove which is communicated with a lowest portion of the inclined surface of the upper groove and is formed on a side of the internal cover.

6 Claims, 11 Drawing Sheets

ELECTRICAL JUNCTION BOX

This application is a Divisional of Application Ser. No. 10/828,355, filed Apr. 21, 2004, now U.S. Pat. No. 7,077,667 which claims the benefit of priority to Japanese Application Nos. 2003-117208, 2003-117213, and 2003-117221, all filed on Apr. 22, 2003, the entire disclosures of which are incorporated herein by reference.

BACKGROUND OF THE INVENTION

1. Field of the Invention

The present invention relates to an electrical junction box which houses fuses and relay parts in a case thereof.

2. Description of the Related Art

As a conventional electrical junction box of this kind, one is disclosed in DE Patent Application Laid-Open No. 3209915. As shown in FIG. 1, in this electrical junction box 50, a relay part 52 is housed in a case 51. In the case 51, a fuse mounting part 53 is provided above the relay part 51. A fuse 54 is freely attached/detached to/from the fuse mounting part 53 from above the case 51.

The electrical junction box 50 described above has an advantage that a state of the fuse 54 can be inspected, and the fuse 54 can be replaced, from above the case 51.

However, in the conventional electrical junction box 50, the fuse mounting part 53 is disposed in a state of being exposed to an upper surface of the case 51. It is unavoidable that a water droplet or the like resulting from dew condensation enters the case 51 through the fuse mounting part 53. When water enters the case 51, there is a problem that failure is caused by the water wetting the relay part 52 and the like.

Moreover, as an electrical junction box mounted on a vehicle, there is one in which a branch circuit for distributing and supplying power for a vehicle to each load of the vehicle is of conductive bus bars having high rigidity (Japanese Patent Application Laid-Open No. 5 (1993)-54787). As a configuration of the electrical junction box described above, the electrical junction box includes: a first bus bar in which one set of fuse terminals and the like are integrally formed; a second bus bar in which the other set of fuse terminals and the like are integrally formed; and a bus bar insulating block body which is fixed to the second bus bar. By attaching the first bus bar to the bus bar insulating block body, the first and second bus bars are positioned in correct relative positions. The first and second bus bars which are assembled as described above are housed in the case.

Incidentally, with regard to a positioning structure in which a first bus bar and a bus bar insulating block body are assembled in correct relative positions, the following structure is generally adopted. Specifically, the first bus bar is fitted to a surface of the bus bar insulating block body where the first bus bar is attached. Thereafter, a concave groove which is one step lower than a surrounding surface is formed. Subsequently, the first bus bar and the bus bar insulating block body are assembled in correct relative positions by fitting the first bus bar into the concave groove.

However, in the positioning structure described above, it is required to align the first bus bar with the concave groove of the bus bar insulating block body as a whole. Moreover, the concave groove of the bus bar insulating block body is formed to have a depth which is almost equal to a thickness of the first bus bar. Thus, sometimes, it is impossible to easily determine whether or not the first bus bar is in a state of being completely fitted into the concave groove of the bus bar insulating block body. Consequently, there may be a problem of poor assembly workability. When the first bus bar and the bus bar insulating block body are not assembled in appropriate positions, the first and second bus bars are not assembled in correct relative positions. Accordingly, for example, a pair of fuse terminals formed between the bus bars is in a state of being out of position. Therefore, there arises a problem of causing mounting failure of fuses or the like.

Moreover, in an electrical junction box described above, in order to achieve miniaturization, a plurality of relay parts are put together and arranged in the case. Thus, a large amount of heat is generated. Particularly, in an electrical junction box which distributes and supplies a large current, a means for radiating the heat are essential. Here, in order to improve a heat radiation property, it is considered to elongate the second bus bar in a straight manner and increase a heat radiation area. However, such an electrical junction box comes large in size.

SUMMARY OF THE INVENTION

The present invention was made to solve the problems described above. It is an object of the present invention to provide an electrical junction box capable of preventing failure due to water invasion even if water enters into a case.

Moreover, it is another object of the present invention to provide a bus bar positioning structure which allows a first bus bar and an insulation block body to be easily and securely assembled in respective correct positions and which allows a first and a second bus bars to be positioned in correct relative positions, as well as to provide an electrical junction box including the bus bar positioning structure.

Moreover, it is still another object of the present invention to provide an electrical junction box excellent in a heat radiation property while being miniaturized.

In order to achieve the foregoing objects, an electrical junction box according to a first aspect of the present invention includes: a case; a relay part housed in the case; a fuse mounting part which is provided above the relay part in the case, the fuse mounting part allowing a fuse to be attached/detached to/from the fuse mounting part; a watertight wall which is provided in the case and covers a periphery of the relay part; a drainage channel through which water flows downward, the drainage channel being provided in an outer surface of the watertight wall; and a drainage hole which is provided in the case and drains the water flowing through the drainage channel to the outside of the case.

In the electrical junction box described above, when a water droplet or the like resulting from dew concentration enters into the case through the fuse mounting part, water flows through the drainage channel in the case to be drained to the outside from the drainage hole of the case.

In a preferred embodiment of the present invention, the drainage channel includes: an upper groove which is formed in an upper surface of the outside of a watertight wall, and allows water entering through the fuse mounting part to flow therein, as well as which has an inclined surface on its bottom; and a side groove which communicates with a lowest portion of the inclined surface of the upper groove, and which is formed in a lateral surface of the watertight wall.

In this electrical junction box, the drainage channel can be formed by forming the upper groove and the side groove in the outer surface of a watertight wall.

The drainage hole is a lower-side drainage hole which is opened in a lowest position of the side groove. In this electrical junction box, all of the water entering into the case can be surely drained to the outside of the case.

The drainage hole is an upper-side drainage hole which is opened in a lowest position of the inclined surface. In this electrical junction box, water flowing on the inclined surface of the upper groove would be drained to the outside of the case without causing the water to flow into the side groove.

The watertight wall includes: a bus bar supporting resin body which supports the second bus bar; and an internal cover which is attached to the relay part side of the bus bar supporting resin body. In this electrical junction box, an effect similar to that described above would be obtained.

In an area where the bus bar supporting resin body and the internal cover overlap with each other, a nearly wedge-shaped space progressively expanding downward is formed by the bus bar supporting resin body and the internal cover.

In this electrical junction box, the nearly wedge-shaped space progressively expanding downward is formed by the bus bar supporting resin body and the internal cover. Thus, when a water droplet flows into the area where the bus bar supporting resin body and the internal cover overlap with each other, the water droplet is prevented by the nearly wedge-shaped area from flowing into an inner interstice.

A bus bar positioning structure according to a second aspect of the present invention includes: a first bus bar; a second bus bar; a bus bar attaching body including the second bus bar; an internal cover to which the first and second bus bars are fixed so as to be located in their installation positions, respectively; a first positioning hole which is provided in one of the first bus bar and the internal cover; and a first positioning protrusion which is provided in the other thereof.

In this bus bar positioning structure, the first bus bar and the internal cover can be assembled by inserting the first positioning protrusion into the first positioning hole with reference to the inserted portion as the assembly reference position.

In a preferred embodiment, a second positioning hole may be provided in one of the bus bar attaching body and the internal cover and a second positioning protrusion may be provided in the other thereof.

In this bus bar positioning structure, as in the case of assembling the first bus bar and the bus bar insulating block body, the second bus bar can be attached to the internal cover by inserting the second positioning protrusion into the second positioning hole with reference to the inserted portion as an assembly reference position. Thus, assembly accuracy between the first and second bus bars is improved.

In each of the first and second bus bars, fuse terminals are formed so that the fuse terminals pair with each other. In this bus bar positioning structure, the fuse terminals to pair with each other are disposed in correct relative positions.

The first bus bar is fitted into the internal cover, and a bus bar fitting concave part is formed to be one step lower than a surround surface. In this bus bar positioning structure, the first bus bar is fitted into the bus bar fitting concave part of the internal cover. Thus, the first bus bar and the bus bar insulating block body are assembled.

The first positioning hole may be provided in the first bus bar and the first positioning protrusion may be provided in the internal cover. In this bus bar positioning structure, an effect similar to that described above is obtained.

The bus bar positioning structure may be included in an electrical junction box. In this electrical junction box, an effect similar to that described above is obtained by use of the positioning structure inside.

An electrical junction box according to a third aspect of the present invention includes: a first bus bar which has a power terminal formed therein and distributes and supplies power derived from the power terminal; a second bus bar in which a plurality of relay parts, to each of which power is supplied from the first bus bar, are fixed to each relay fixing part and in which control terminals and output terminals of the relay parts are formed; and a case which houses the first and second bus bars therein and has a connector cavity part in which the power terminal, the control terminals and the output terminals are arranged. In the second bus bar, a folded part which is folded in a plane direction of the bus bar is formed.

In this electrical junction box, an actual length of the second bus bar is increased by the folded part and a heat radiation area is the larger. Meanwhile, the length of the second bus bar in its height direction is suppressed.

In a preferred embodiment, the folded part is set, surrounded by the relay fixing part, the control terminals and output terminals, and within a range that the control terminals and the output terminals can be arrayed in the connector cavity.

In this electrical junction box, the control terminals and output terminals of the second bus bar are arrayed in the connector cavity without enlarging the connector cavity in its width direction.

The folded part may be folded nearly right-angled to a direction in which the relay parts are fixed to the relay fixing part and may be folded nearly right-angled to the control terminals and the output terminals.

In this electrical junction box, the actual length of the second bus bar is increased by the full length of the folded part and the relay parts are arrayed along the folded part.

The control terminals and the output terminals, extending from the periphery of the relay fixing part, may be put together in the folded part and the control terminals and the output terminals may be put together and arrayed in the connector cavity.

In this electrical junction box, the control terminals and the output terminals, which are dispersed in the second bus bar, are put together in the folded part. Thus, the length of the second bus bar in its height direction is suppressed while increasing the heat radiation area.

DESCRIPTION OF THE EMBODIMENTS

With reference to the drawings, a first embodiment of the present invention will be described below.

Figure 1:
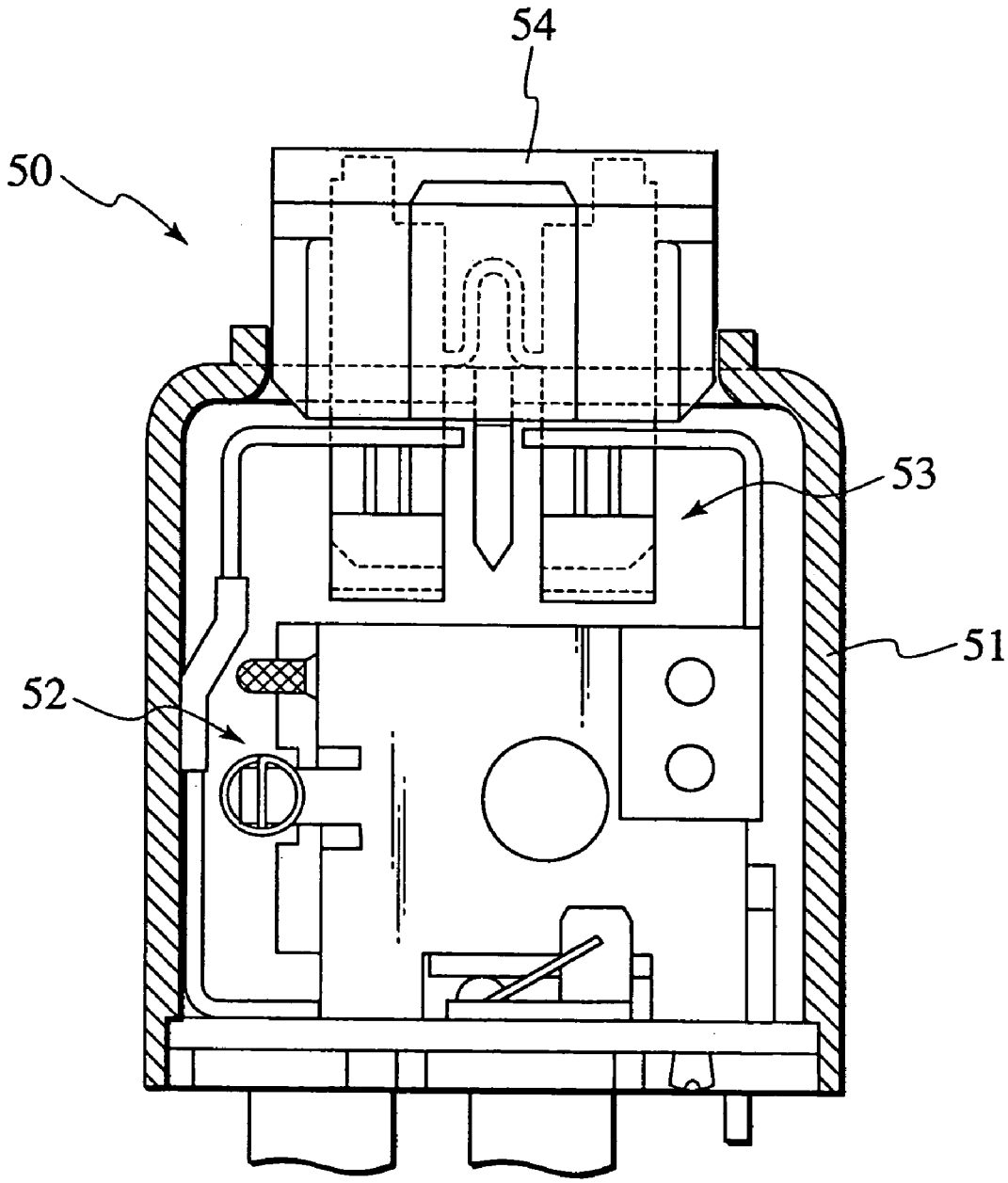
FIG.1 PRIOR ART
FIG. 1 is a cross-sectional view of a conventional electrical junction box.
Figure 2:
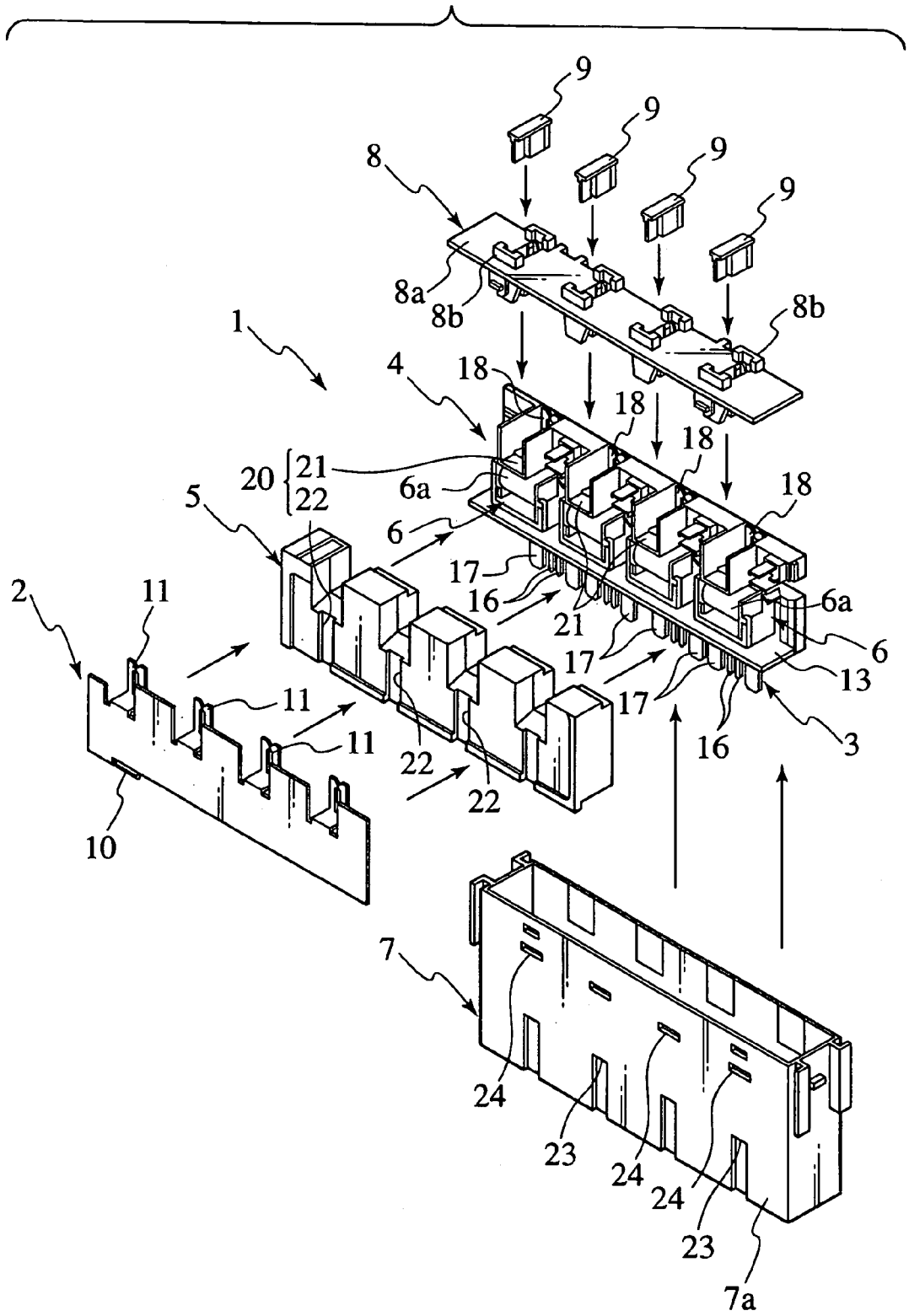
FIG. 2 is an exploded perspective view of an electrical junction box, showing a first embodiment of the present invention.
Figure 3:
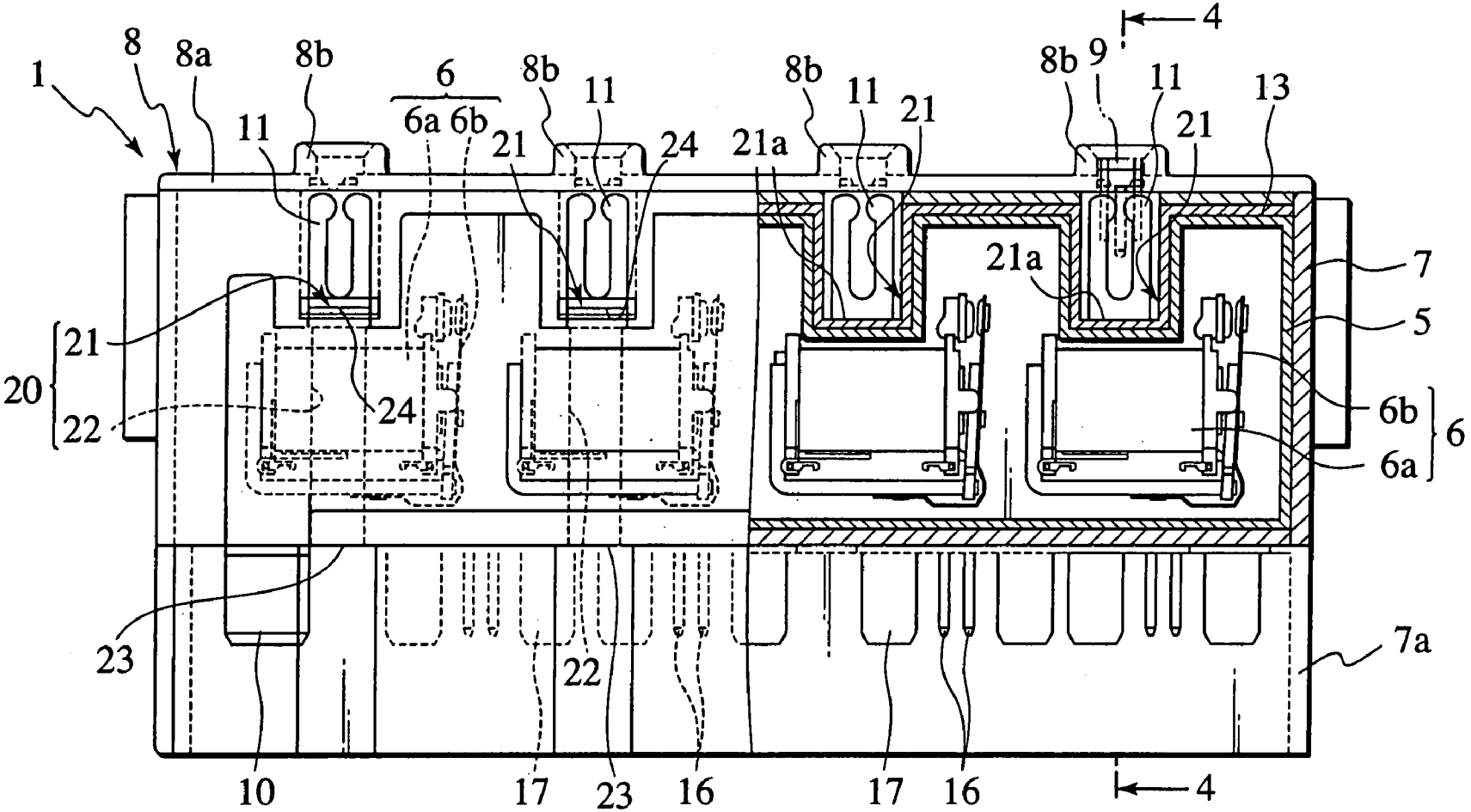
FIG. 3 is a partially fractured front view of the electrical junction box, showing the first embodiment of the present invention.
Figure 4:
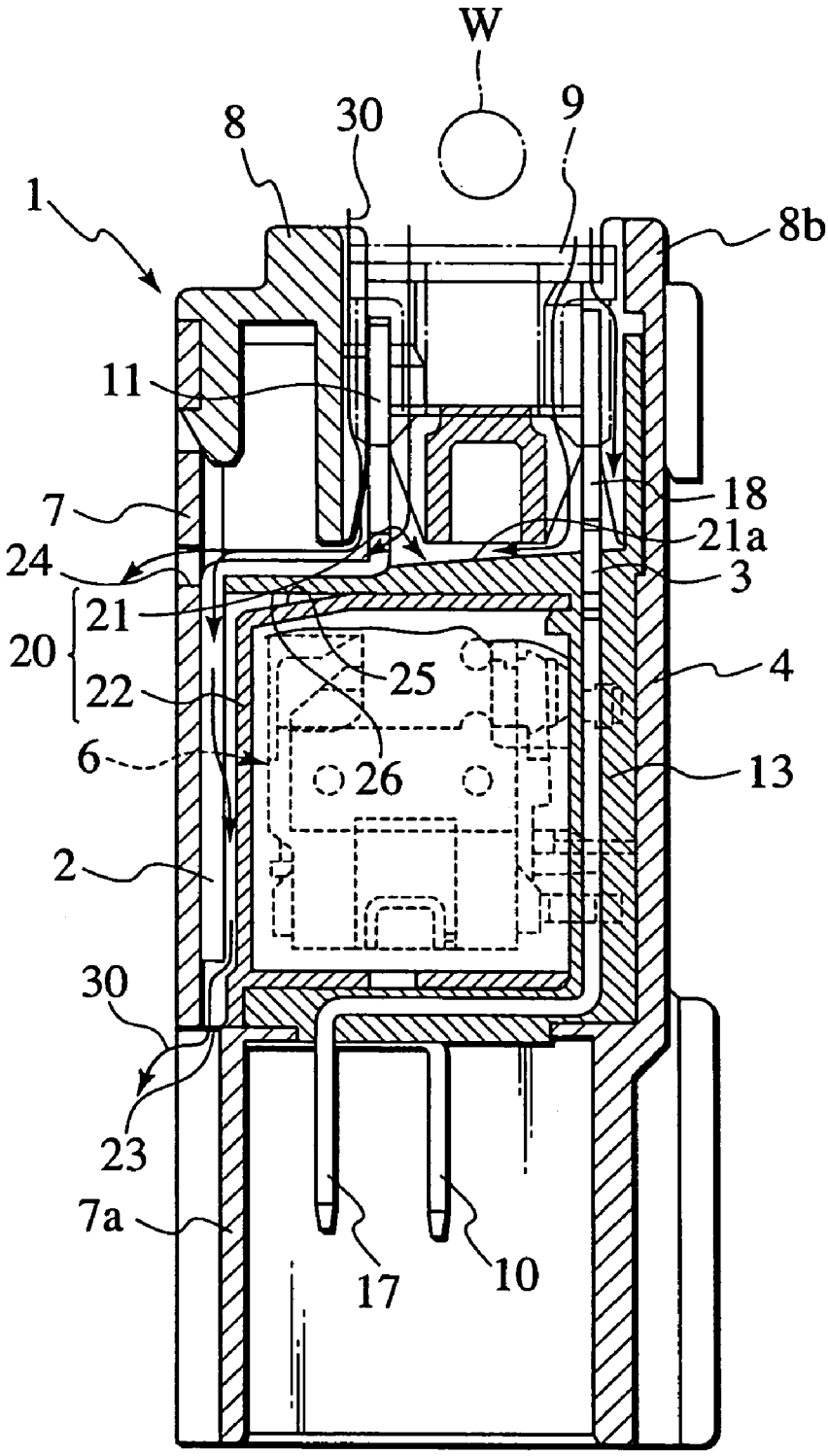
FIG. 4 is a cross-sectional view along the line 4—4 in FIG. 3, showing the first embodiment of the present invention.

As shown in FIGS. 2 to 4, an electrical junction box 1 includes: a first bus bar 2; a bus bar attaching body 4 to which a second bus bar 3 is attached; an internal cover 5 which is attached to the bus bar attaching body 4 and covers relay parts 6; a case 7 which houses the first bus bar 2, the bus bar attaching body 4 and the internal cover 5; a fuse cavity 8 which is attached to an upper side of the case 7; and four fuses 9 which are mounted on fuse terminals 11 and 18 that are provided in the fuse cavity 8 in a protruding condition. Note that the arrow 30 in FIG. 4 shows a direction in which a water droplet W entering the case 7 through a fuse mounting part 8*b* is drained through a drainage channel in the electrical junction box 1.

The first bus bar 2 is manufactured by press-molding a rigid, conductive sheet metal having rigidity in a predetermined shape. A power terminal 10 is formed at a lower end of the first bus bar 2, and a fuse terminal 11 is formed in each of the four spots of an upper end thereof.

The bus bar attaching body 4 is manufactured in the following manner. Specifically, a rigid, conductive sheet metal having rigidity is press-molded in a predetermined shape to form an integrated prototype bus bar. Thereafter, a bus bar supporting resin body 13 is insert-molded with the integrated prototype bus bar to form an insert-molded part. Subsequently, a predetermined spot of the integrated prototype bus bar of the insert-molded part is cut to form the second bus bar 3 that is a desired relay wiring route body. Thereafter, coils 6*a* and switches 6*b* of the relay parts 6 are fixed to the second bus bar 3. In the bus bar attaching body 4 manufactured as described above, four pairs of control terminals 16 and output terminals 17 are formed at its lower end and the fuse terminals 18 are formed in four spots of its upper end.

The internal cover 5 is attached to the relay part 6 side of the bus bar supporting resin body 13. The internal cover 5 and the bus bar supporting resin body 13 cover the entire periphery of the coils 6*a* and switches 6*b* of the four relay parts 6. Specifically, the internal cover 5 and the bus bar supporting resin body 13 are configured as a watertight wall which covers the entire periphery of the four relay parts 6.

The case 7 is shaped like a rectangular solid hollowed out with openings in its upper and lower surfaces. A lower part of the case 7 is formed as a connector cavity 7*a*. In this case 7, the first and second bus bars 2 and 3 are housed in an assembled state from the opening in the upper surface. In the connector cavity 7*a*, the power terminal 10 of the first bus bar 2 and the four pairs of control terminals 16 and output terminals 17 of the second bus bar 3 are arrayed.

The fuse cavity 8 is mounted on the upper side of the case 7 and includes: a plate part 8*a* which closes the upper opening of the case 7; and the fuse mounting parts 8*b* which are formed in four spots of the plate part 8*a* and arrayed in positions facing the respective pairs of fuse terminals 11 and 18. An operator can attach/detach the fuses 9 to/from the respective fuse mounting parts 8*b* from above the case 7.

Moreover, on outer surfaces of the internal cover 5 and the bus bar supporting resin body 13, which are the watertight walls, drainage channels 20 through which water flows downward are formed. Each of the drainage channels 20 includes: an upper concave groove 21 which is formed in an upper surface of the outside of the bus bar supporting resin body 13, which guides water entering through the fuse mounting part 8*b* to flow therein, and whose base constitutes an inclined surface 21*a*; and a side concave groove 22 which is communicated with the lowest portion of the inclined surface 21*a* of the upper concave groove 21 and which is formed in a lateral surface of the internal cover 5. Moreover, in the case 7, lower drainage holes (drainage holes) 23 and upper drainage holes (drainage holes) 24 are provided, from which water flowing through the drainage channels 20 is drained to the outside of the case 7. Below the lower drainage holes 23, concave grooves extending in a vertical direction are formed. When assembled, each of the upper drainage holes 24 is open towards the lowest position of the inclined surface 21*a* of each upper concave groove 21 of the bus bar supporting resin body 13, and is formed as a through-hole penetrating between inner and outer surfaces of the case 7. When assembled, each of the lower drainage holes 23 is open towards the lowest position of each of the side concave grooves 22 of the internal cover 5.

Furthermore, on the outer lateral surface of the internal cover 5 in an area where the bus bar supporting resin body 13 and the internal cover 5 overlap with each other, a slope 25 is provided. Thus, a nearly wedge-shaped space 26 progressing expanding downward is formed by the bus bar supporting resin body 13 and the internal cover 5.

In the foregoing electrical junction box 1, water may enter the case 7 through the fuse mounting part 8*b* when the water droplet W is produced by dew concentration in an upper part of the electrical junction box 1 or when water is splashed over the upper part of the electrical junction box 1 since a vehicle is spattered with water. Water entering into the case 7 through the fuse mounting part 8*b* flows into the upper concave groove 21 of the bus bar supporting resin body 13 and flows down on the inclined surface 21*a*, that is the base of the upper concave groove 21, by its own weight. Accordingly, when the water reaches the lowest position of the inclined surface 21*a*, the water is drained to the outside of the case 7 through the upper drainage hole 24 of the case 7. Moreover, water which is not drained from the upper drainage hole 24 flows down through the side concave groove 22 of the internal cover 5 by its own weight. When the water reaches the lowest position of the side concave groove 22, the water is drained to the outside of the case 7 from the lower drainage hole 23 of the case 7. As described above, even if water enters into the case 7, relay parts 6 and the like are not covered with water. Thus, failure which would be otherwise cause by water invasion can be prevented.

In the embodiment described above, a drainage channel 20 includes: an upper concave groove 21 which is formed in the upper surface of the outside of a bus bar supporting resin body 13, which guides water entering through a fuse mounting part 8*b* to flow therein, and whose base constitutes a inclined surface 21*a*; and a side concave groove 22 which is communicated with the lowest portion of the inclined surface 21*a* of the upper concave groove 21, and which is formed in a lateral surface of an internal cover 5. Thus, the drainage channel 20 can be created by forming the upper concave groove 21 in the outer surface of the bus bar supporting resin body 13, and by forming the side concave groove 22 in the outer surface of the internal cover 5. Consequently, it is possible to easily create the drainage channel 20 merely by making minor changes in design regarding shapes of a conventional bus bar supporting resin body 13 and an internal cover 5.

In the embodiment described above, one of a pair of drainage holes is the lower drainage hole 23 which is open towards the lowest position of the side concave groove 22. Thus, all of the water flowing into the case 7 can be surely drained to the outside of the case 7.

In the embodiment described above, the other of the pair of drainage holes is the upper drainage hole 24 which is open towards the lowest position of the inclined surface 21*a*. Thus, water flowing down on the inclined surface 21*a* can be drained to the outside of the case 7 without allowing the water to flow into the side concave groove 22. Consequently, water can be quickly drained to the outside of the case 7. Moreover, an amount of the water flowing through the side concave groove 22 can be reduced. Thus, it is less likely that entering water wets relay parts 6 and the like.

Furthermore, in the embodiment described above, a nearly wedge-shaped space 26 which extends downward is formed of a bus bar supporting resin body 13 and a slope 25 of the internal cover 5. Thus, when water droplet flows into the area where a bus bar supporting resin body 13 and an internal cover 5 overlap with each other, water droplet is prevented by a nearly wedge-shaped space 26 from flowing into a interstice therein.

In the embodiment described above, a watertight wall is formed of a bus bar supporting resin body 13 which supports a second bus bar 3 and an internal cover 5 which is attached to the side of the bus bar supporting resin body 13 to which relay parts 6 are fixed. However, it is needless to say that, if watertight covers the entire periphery of the relay parts 6, it is sufficient.

FIGS. 5 to 9 show how a bus bar positioning structure according to a second embodiment of the present invention is applied to a bus bar housed in an electrical junction box.

Figure 5:
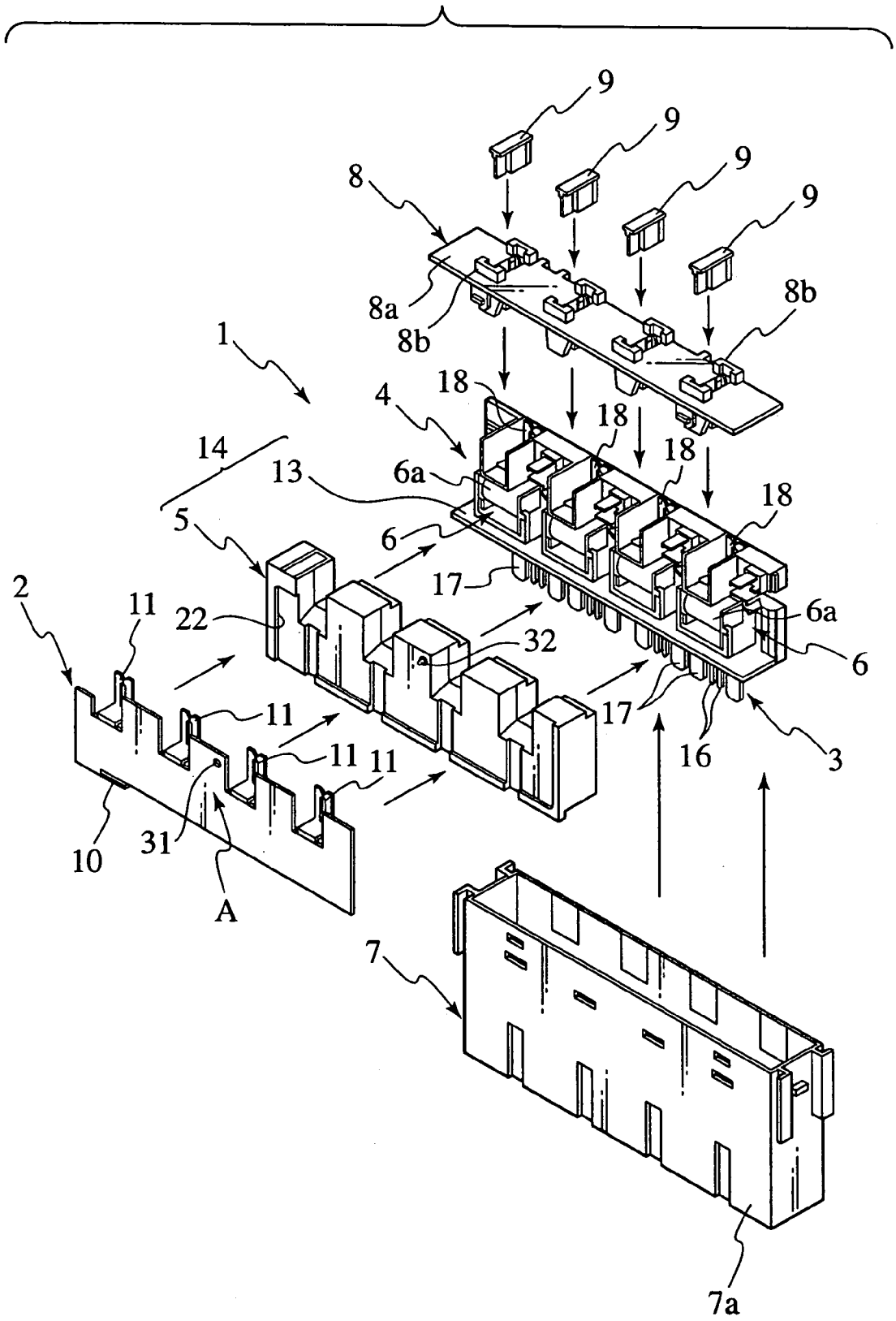
FIG. 5 is an exploded perspective view of an electrical junction box, showing a second embodiment of the present invention.
Figure 6:
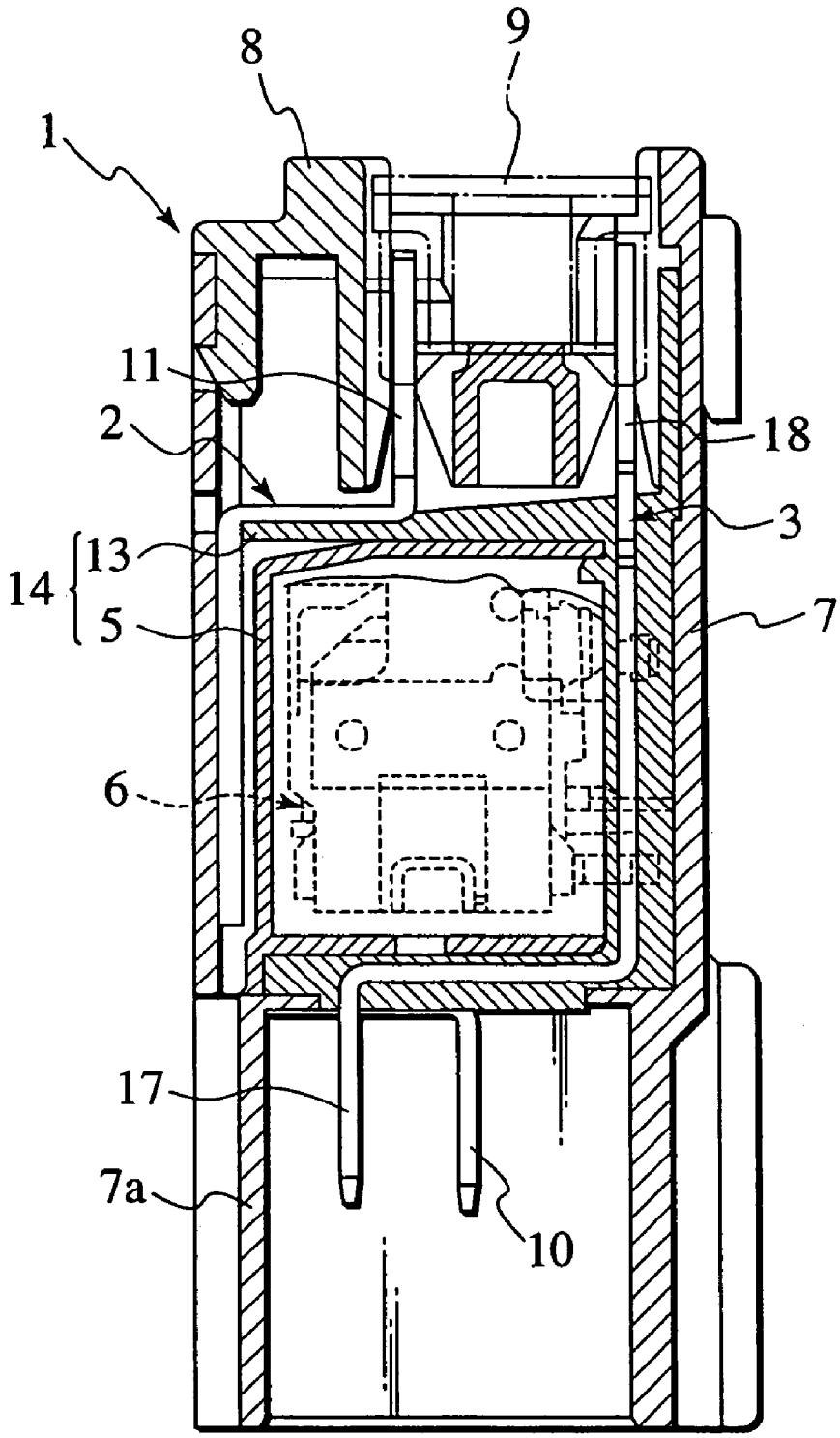
FIG. 6 is a cross-sectional view of the electrical junction box in such a state that a first bus bar including fuse terminals, an internal cover and a second bus bar are assembled, showing the second embodiment of the present invention.
Figure 7:
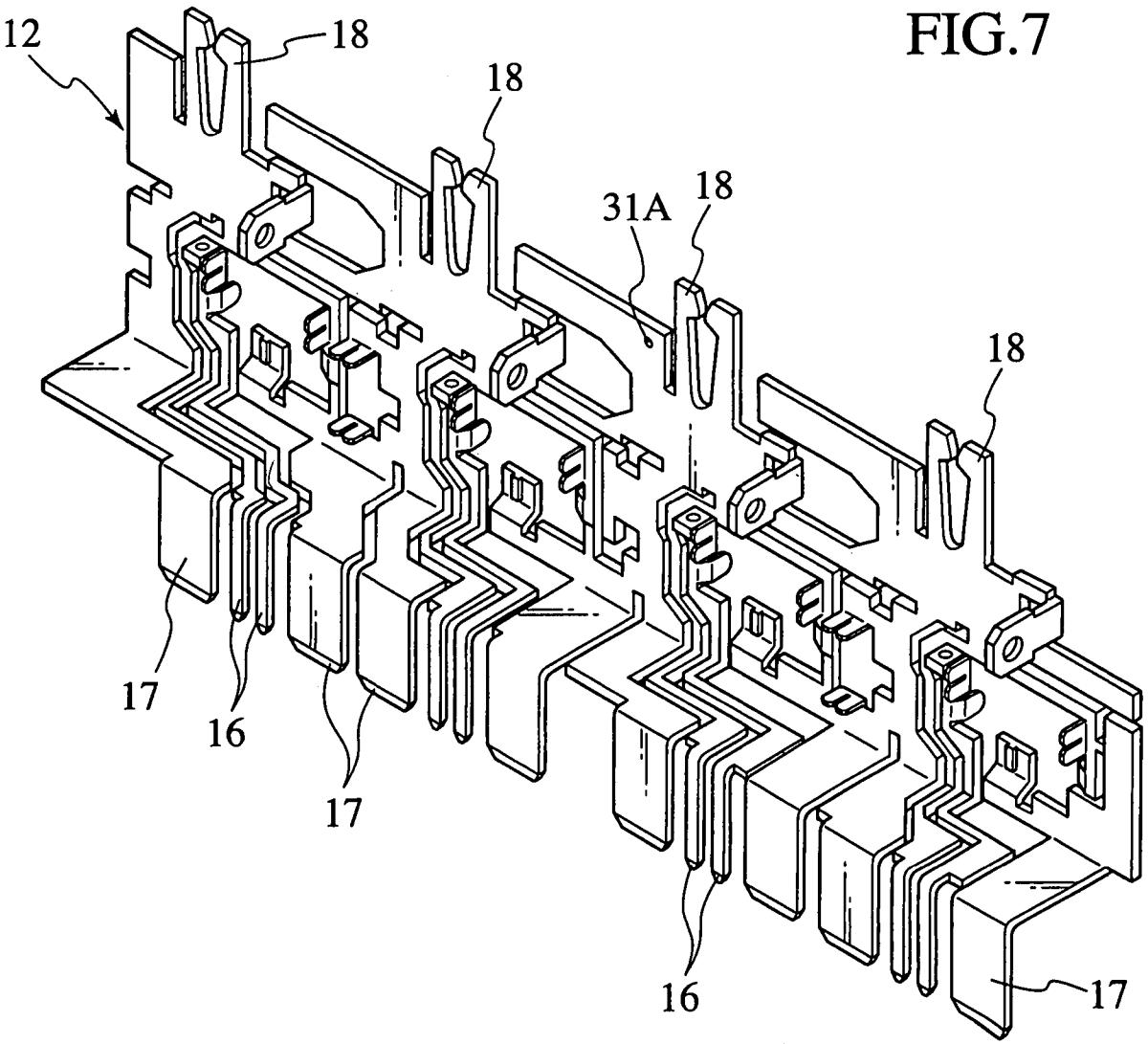
FIG. 7 is a perspective view of an integrated prototype bus bar that is produced in a manufacturing process of a first bus bar, showing the second embodiment of the present invention.

As shown in FIGS. 5 and 6, an electrical junction box 1 includes: a first bus bar 2; a bus bar attaching body 4 to which a second bus bar 3 is attached; an internal cover 5 which is attached to the bus bar attaching body 4 and covers relay parts 6; a case 7 which houses the first bus bar 2, the bus bar attaching body 4 and the internal cover 5; a fuse cavity 8 which is attached to an upper side of the case 7; and four fuses 9 which are mounted on fuse terminals 11 and 18 that are arrayed in predetermined positions in a fuse cavity 8.

A first bus bar 2 is manufactured by press-molding a rigid, conductive sheet metal in a predetermined shape. A power terminal 10 is formed at a lower end of the first bus bar 2, and a fuse terminal 11 is formed in each of the four spots of an upper end thereof.

A bus bar attaching body 4 is manufactured in the following manner. Specifically, a rigid, conductive sheet metal is press-molded in a predetermined shape to form an integrated prototype bus bar 12 shown in FIG. 7. Thereafter, a bus bar supporting resin body 13 is insert-molded with the integrated prototype bus bar 12 to form an insert-molded part. Subsequently, a predetermined portion of the integrated prototype bus bar 12 as the insert-molded part is cut out to form a second bus bar 3 that is a desired relay wiring route body. Thereafter, coils 6*a* and switches (not shown) of relay parts 6 are fixed to the second bus bar 3. In a bus bar attaching body 4 manufactured as described above, four pairs of control terminals 16 and output terminals 17 are formed at its lower end, a fuse terminal 18 is formed in each of the four spots of its upper end, and the coils 6*a* and switches (not shown) of the relay parts 6 are fixed to its center portion.

With reference to FIGS. 5 and 6, an internal cover 5 is formed of a resin material, and is fixed to a bus bar supporting resin body 13 so as to cover the entire periphery of the coils 6*a* and switches (not shown) of the four relay parts 6. The bus bar supporting resin body 13 and the internal cover 5 are configured as a bus bar insulating block body 14 which is fixed to the second bus bar 3. The first bus bar 2 is inlayed, in a state of being positioned, to an outer surface of the internal cover 5 by means of a bus bar positioning means A. Note that a configuration of the positioning means A will be described later.

A case 7 is shaped like a rectangular solid hollowed out with openings in its upper and lower surfaces. A lower part of the case 7 is formed as a connector cavity 7*a*. In this case 7, a first and a second bus bars 2 and 3 are housed by being inserted, in an assembled state, from the opening in the upper surface. In the connector cavity 7*a*, the power terminal 10 of a first bus bar 2 and the four pairs of control terminals 16 and output terminals 17 of a second bus bar 3 are arrayed.

A fuse cavity 8 is mounted on the upper side of a case 7 and includes: a plate part 8*a* which closes the upper opening of the case 7; and fuse mounting parts 8*b* which are formed in the four spots on the plate part 8*a*, and which are arrayed in positions facing the respective pairs of fuse terminals 11 and 18.

Next, the bus bar positioning means A will be described. As will be described in detail in FIGS. 8A and 8B and FIG. 9, this positioning means A includes: a first positioning hole 31 which is formed in a first bus bar 2; a first positioning protrusion 32 which is provided in a surface of the internal cover 5 where the first bus bar 2 is disposed, and which is inserted into the first positioning hole 31; and a bus bar fitting concave part 22 which is formed in the surface of the internal cover 5 where the first bus bar 2 is disposed, to which the first bus bar 2 is inlayed, and which is one step lower than a surrounding surface. Moreover, the positioning means A includes: a second positioning hole 31A which is formed in a bus bar attaching body 4; and a second positioning protrusion 32A which is provided on the reverse side of a surface of the internal cover 5 where the first bus bar 2 is disposed, and which is inserted into the second positioning hole 31A. Note that the second positioning hole 31A may be formed only in the bus bar supporting resin body 13 of the bus bar attaching body 4, or may be formed in both of the bus bar supporting resin body 13 and the second bus bar 3.

Figure 9:
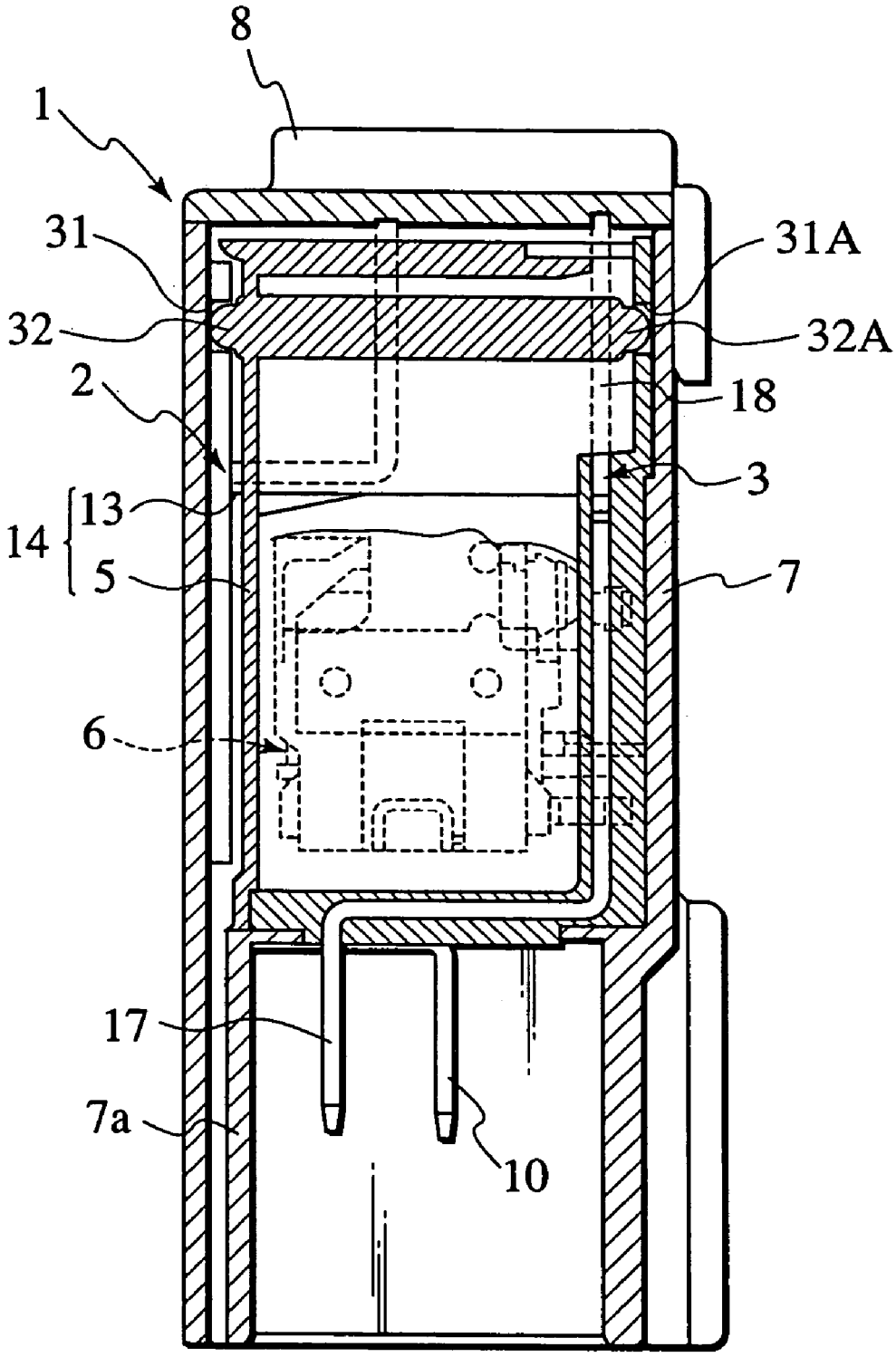
FIG. 9 is a cross-sectional view of the electrical junction box in such a state that the first bus bar including a -positioning structure, the internal cover and the second bus bar are assembled, showing the second embodiment.

Next, an assembly operation of the electrical junction box 1 described above will be described. An internal cover 5 is attached to a bus bar supporting resin body 13 of a bus bar attaching body 4 to which a second bus bar 3 is fixed. Here, as shown in FIG. 9, the internal cover 5 and the bus bar attaching body 4 are aligned with each other by inserting the second positioning protrusion 32A of the bus bar attaching body 4 into the second positioning hole 31A of the internal cover 5. Accordingly, the bus bar attaching body 4 is attached to a predetermined position on the internal cover 5. Thus, the bus bar insulating block body 14 is formed of the bus bar supporting resin body 13 and the internal cover 5.

Figure 8A:
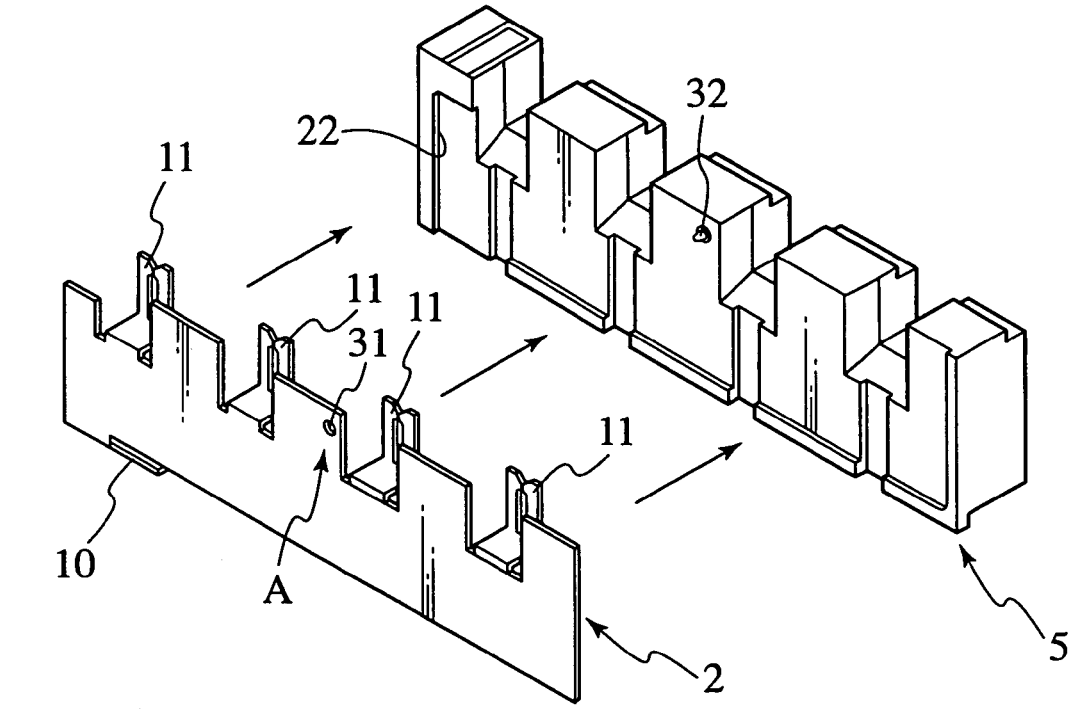
FIG. 8A is a perspective view of a state before the first bus bar and the internal cover are assembled, showing the second embodiment of the present invention.
Figure 8B:
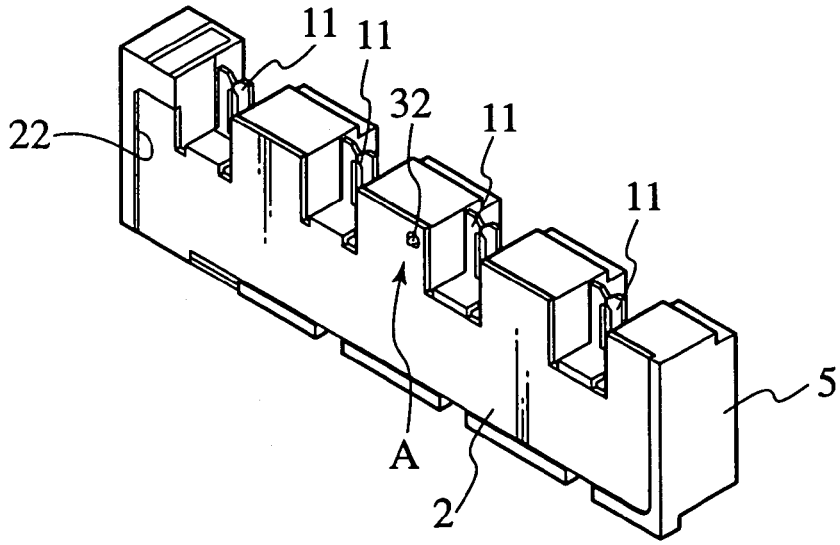
FIG. 8B is a perspective view showing how the first bus bar and the internal cover are assembled, showing the second embodiment of the present invention.

Next, as shown in FIG. 8A, a first bus bar 2 is aligned with the outer surface of an internal cover 5. Thereafter, as shown in FIG. 8B, a first positioning protrusion 32 of the internal cover 5 is inserted into a first positioning hole 31 of the first bus bar 2, and the first bus bar 2 is fitted into a bus bar fitting concave part 22 of the internal cover 5 to assemble the internal cover 5 and the first bus bar 2. Subsequently, this assembled body of the first and second bus bars is inserted into the case 7. Next, a fuse cavity 8 is mounted on the upper side of the case 7, and a fuse 9 is mounted on each of fuse mounting parts 8*b* of a fuse cavity 8.

In the foregoing steps of the assembly operation, a first bus bar 2 and a bus bar insulating block body 14 can be assembled by inserting a first positioning protrusion 32 of a internal cover 5 into a first positioning hole 31 of the first bus bar 2 with reference to the inserted portion as an assembly reference position. Thus, the first bus bar 2 and the bus bar insulating block body 14 can be easily and surely assembled in an appropriate state. Consequently, a first and a second bus bars 2 and 3 are in correct relative positions.

Moreover, in the embodiment described above, a second bus bar and an internal cover can be assembled by inserting a second positioning protrusion into a second positioning hole with reference to the inserted portion as an assembly reference position. Thus, assembly accuracy in relative position between the first and second bus bars is improved.

In the embodiment described above, the terminals of a first and a second bus bars 2 and 3 include a pair of fuse terminals 11 and 18. Thus, the paired fuse terminals 11 and 18 are arranged in correct relative positions. Consequently, it is possible to prevent an accident of defectively mounting fuses 9.

In the embodiment described above, in an internal cover 5 of a bus bar insulating block body 14, a first bus bar 2 is fitted, and a bus bar fitting concave part 22 which is one step lower than the surrounding surface is formed. Thus, the first bus bar 2 and the bus bar insulating block body 14 are assembled in such a state that the first bus bar 2 is fitted into the bus bar fitting concave part 22 of the bus bar insulating block body 14. Consequently, the first bus bar 2 and the bus bar insulating block body 14 are surely and firmly positioned.

In the embodiment described above, a first positioning hole 31 is provided in a first bus bar 2, and a first positioning protrusion 32 is provided in an internal cover 5 of a bus bar insulating block body 14. By contrast, the first positioning protrusion 32 may be provided in the first bus bar 2, and the first positioning hole 31 may be provided in the internal cover 5 of the bus bar insulating block body 14.

Next, with reference to FIGS. 10 and 11, an electrical junction box according to a third embodiment of the present invention will be described.

Figure 10:
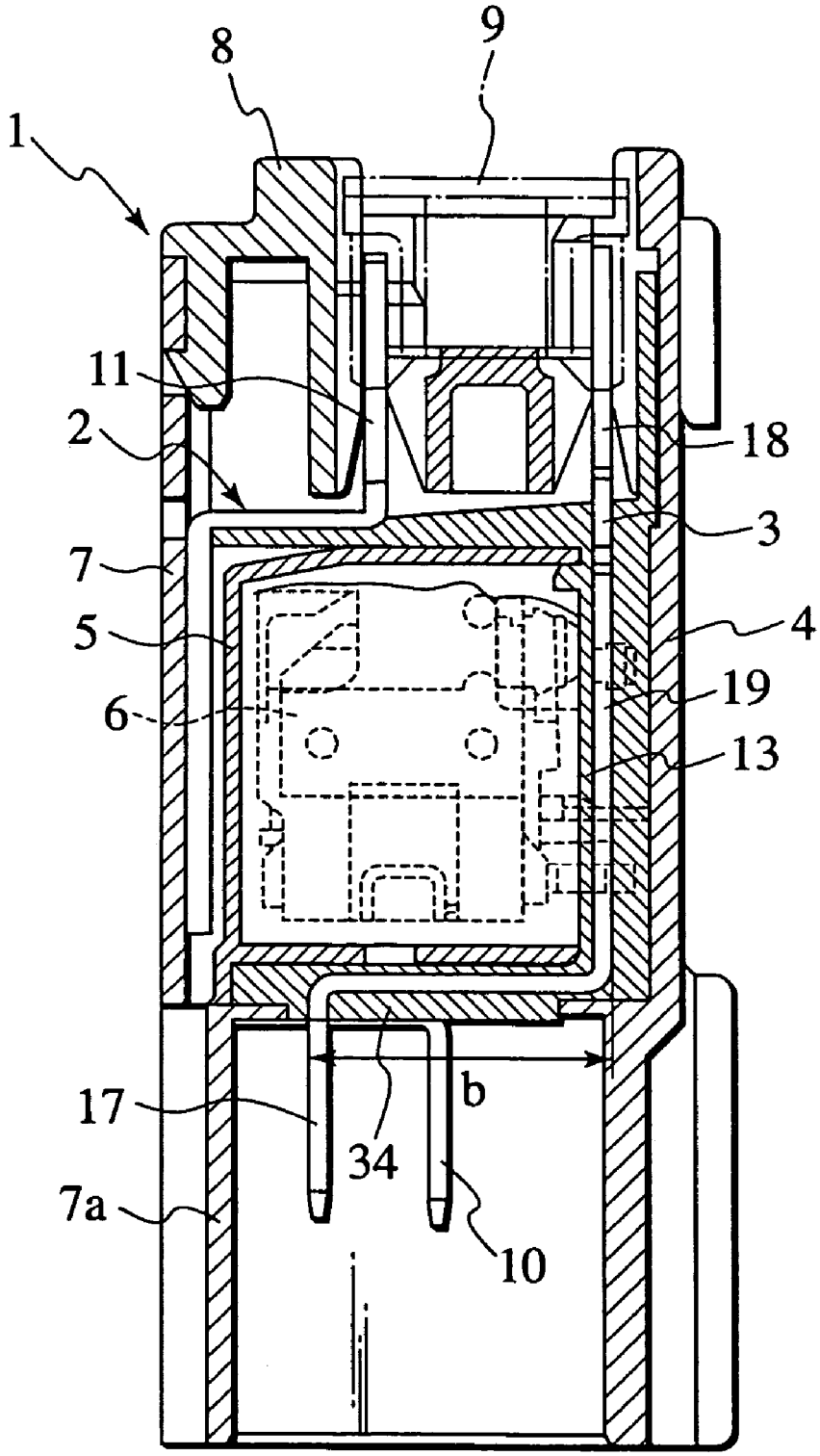
FIG. 10 is a longitudinal section of an electrical junction box, showing a third embodiment of the present invention.
Figure 11:
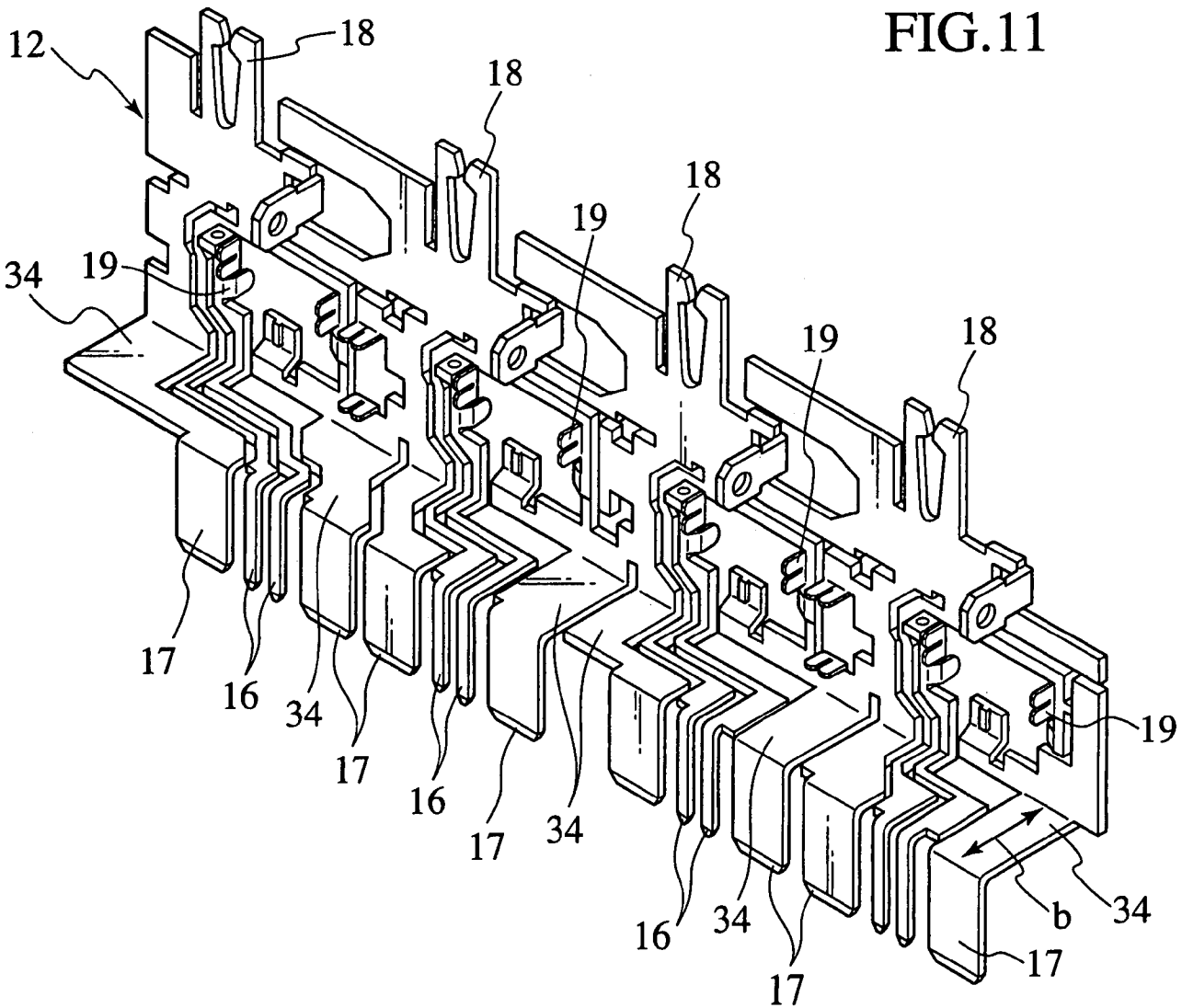
FIG. 11 is a perspective view of an integrated prototype bus bar that is produced in a manufacturing process of a second bus bar, showing the third embodiment of the present invention.

As shown in FIG. 10, an electrical junction box 1 includes: a first bus bar 2; a bus bar attaching body 4 to which a second bus bar 3 is attached; an internal cover 5 which is attached to the bus bar attaching body 4 and covers relay parts 6; a case 7 which houses the first bus bar 2, the bus bar attaching body 4 and the internal cover 5; a fuse cavity 8 which is attached to an upper side of the case 7; and four fuses 9 which are mounted on fuse terminals provided in the fuse cavity 8 in a protruding condition.

The first bus bar 2 is manufactured by press-molding a rigid, conductive sheet metal in a predetermined shape. A power terminal 10 is formed at a lower end of the first bus bar 2, and a fuse terminal 11 is formed in each of the four spots of an upper end thereof.

A bus bar attaching body 4 is manufactured in the following manner. Specifically, a rigid, conductive sheet metal is press-molded in a predetermined shape to form an integrated prototype bus bar 12 shown in FIG. 11. Thereafter, a bus bar supporting resin body 13 is insert-molded with the integrated prototype bus bar 12 to form an insert-molded part. Subsequently, a predetermined portion of the integrated prototype bus bar 12 as the insert-molded part is cut out to form a second bus bar 3 that is a desired relay wiring route body. Thereafter, coils 6*a* and switches (not shown) of a relay parts 6 are fixed to the second bus bar 3. In the bus bar attaching body 4 manufactured as described above, four pairs of control terminals 16 and output terminals 17 are formed at its lower end, and fuse terminals 18 are formed in the four spots of its upper end, and relay fixing parts 19 to which the coils 6*a* and switches (not shown) of the relay parts 6 are fixed are formed in the four spots of its center portion.

Moreover, a distance between each of relay fixing parts 19 of a second bus bar 3 and the corresponding pair of a control terminal 16 and an output terminal 17 thereof is longer than that of the conventional example. Moreover, this elongated portion is formed to be a folded part 34 which is folded securing a range that the control terminals 16 and the output terminals 17 can be arranged in a connector cavity 7*a*. As shown in FIGS. 10 and 11, the folded part 34 is folded in a plane direction of a second bus bar 3. Specifically, the folded part 34 is folded nearly right-angled to a direction in which coils 6*a* and switches (not shown) are fixed, and, at the same time is folded nearly right-angled to the control terminals 16 and the output terminals 17. In other words, in a second bus bar 3, a portion formed of the relay fixing parts 19 and the corresponding pairs of control terminals 16 and the output terminals 17 is shaped like a crank. The folded part 34 has a step portion with a width b.

With reference to FIG. 10, an internal cover 5 is attached to a bus bar supporting resin body 13. The internal cover 5 and the bus bar supporting resin body 13 cover the entire periphery of coils 6*a* and switches (not shown) of the four relay parts 6. The case 7 is shaped like a rectangular solid hollowed out with openings in its upper and lower surfaces. A lower part of the case 7 is formed as a connector cavity 7*a*. In this case 7, a first and a second bus bars 2 and 3 are housed by being inserted, in an assembled state, from the opening in the upper surface. In a connector cavity 7*a*, a power terminal 10 of the first bus bar 2 and the four pairs of control terminals 16 and output terminals 17 of the second bus bar 3 are arrayed.

A fuse cavity 8 is mounted on the upper side of the case 7 and includes: a plate part 8*a* which closes the upper opening of the case 7; and the fuse mounting parts 8*b* which are formed in four spots of the plate part 8*a* and arranged in positions facing the respective pairs of fuse terminals 11 and 18.

As described above, in the electrical junction box 1 described above, an actual length of the second bus bar 3 is the longer because of the folded part 34, and consequently a heat radiation area is the larger as well. Meanwhile, the length of the second bus bar 3 in its height direction is suppressed. Thus, a heat radiation property can be improved while keeping the electrical junction box 1 compact in its height direction. In addition, in the embodiment described above, the folded part 34 is set between each of the relay fixing parts 19 and the corresponding pairs of control terminals 16 and output terminals 17, and securing a range that the control terminals 16 and the output terminals 17 can be arranged in the connector cavity 7*a*. Thus, the control terminals 16 and output terminals 17 of the second bus bar 3 are arranged inside without increasing the size of the connector cavity 7*a* in its width direction. Consequently, the electrical junction box 1 can also be kept compact in its width direction.

Specifically, in the case that a second bus bar 3 of the present invention and a conventional second bus bar are set equal to each other in height, the actual length of the second bus bar 3 of the present invention is the longer because of a folded part 34, compared to the conventional one and the heat radiation area is the larger as well. Meanwhile, control terminals 16 and output terminals 17 of a second bus bar 3 are arranged in a connector cavity 7*a* which has the same height and width as those of a conventional example. As described above, the heat radiation property can be improved while keeping the electrical junction box 1 compact in both of the height and width directions.

Furthermore, control terminals 16 and the output terminals 17, all extending from the periphery of a relay fixing parts 19, are put together in the folded part 34, and the control terminals 16 and the output terminals 17 are put together and arranged in the connector cavity 7*a*. Thus, the miniaturizing of the electrical junction box 1 in its height direction is realized.

A folded part 34 of the embodiment described above is folded nearly right-angled to a direction in which coils 6*a* and switches (not shown) of relay parts 6 are fixed to a relay fixing parts 19, and is folded nearly right-angled to the control terminals 16 and the output terminals 17. Thus, the actual length of a second bus bar 3 is increased by approximately the entire length b of the step portion of the folded part 34. Moreover, the coils 6*a* and switches (not shown) of the relay parts 6 are arranged along the folded part 34. Thus, the heat radiation area can be increased. Moreover, the second bus bar 3 and the coils 6*a* and switches (not shown) of the relay parts 6 can be put together and arranged.

Note that, in the embodiment described above, as shown in FIG. 10, in order for the folded part 34 to secure a sufficient heat radiation area, a power terminal 10, an output terminals 17 and a control terminals 16 are arranged so that the power terminal 10 intersects with the output terminals and the control terminals 16. However, when a heat radiation amount is relatively small, the folded part 34 is provided so that the power terminal 10 does not intersect with the output terminals 17 and the control terminals 16. Accordingly, a connector cavity 7*a* can be miniaturized while securing a sufficient heat radiation amount.

What is claimed is:

1. An electrical junction box comprising:

a case;

a relay part housed in the case;

a fuse mounting part which is provided above the relay part in the case, the fuse mounting part allowing a fuse to be attached/detached to/from the fuse mounting part;

a watertight wall which is provided in the case and covers a periphery of the relay part;

a drainage channel through which water flows downward, the drainage channel being provided in an outer surface of the watertight wall; and a drainage hole which is provided in the case and drains the water flowing through the drainage channel to an outside of the case.

2. The electrical junction box according to claim 1, wherein the drainage channel includes an upper groove which is formed in an upper surface of the outside of the watertight wall, allows water entering through the fuse mounting part to flow therein and has an inclined surface on its bottom and a side groove which is communicated with a lowest portion of the inclined surface of the upper groove and is formed in a lateral surface of the watertight wall.

3. The electrical junction box according to claim 2, wherein the drainage hole comprises a lower-side drainage hole which is opened in a lowest position of the side groove.

4. The electrical junction box according to claim 3, wherein the drainage hole comprises an upper-side drainage hole which is opened in a lowest position of the inclined surface.

5. The electrical junction box according to claim 1, wherein the watertight wall includes a bus bar supporting resin body which supports the second bus bar and an internal cover which is attached on the relay part side of the bus bar supporting resin body.

6. The electrical junction box according to claim 5, wherein in an area where the bus bar supporting resin body and the internal cover overlap with each other, a substantially wedge-shaped space extending downward is formed by the bus bar supporting resin body and the internal cover.

* * * * *